United States Patent [19]

Lin

[11] Patent Number: 5,039,146

[45] Date of Patent: Aug. 13, 1991

[54] TUBULAR LATCH HOUSING

[76] Inventor: Jui C. Lin, No. 55-10, Been Chou Rd., KangShan, Kaohsiung Hsien, Taiwan

[21] Appl. No.: 553,636

[22] Filed: Jul. 18, 1990

[30] Foreign Application Priority Data

May 25, 1990 [TW] Taiwan ..... 79205675

[51] Int. Cl.[5] ..... E05C 1/16

[52] U.S. Cl. ..... 292/337; 292/244; 292/DIG. 53; 292/DIG. 60

[58] Field of Search ..... 292/377, 244, 169 R, 292/173, DIG. 53, DIG. 60, DIG. 64

[56] References Cited

U.S. PATENT DOCUMENTS 3,055,691 9/1962 Kessel ..... 292/337

3,190,683 6/1965 Schlage ..... 292/337

*Primary Examiner*—Richard E. Moore

*Attorney, Agent, or Firm*—Fleit, Jacobson, Cohn, Price, Holman & Stern

[57] ABSTRACT

A tubular latch housing having a plurality of projections on its outer periphery for keeping a ring fitted around said housing between said projections and a face plate combined at the outer end of said housing so that said housing can rotate to adjust its position for combining with a lock set even after said housing is mounted in a door.

2 Claims, 3 Drawing Sheets

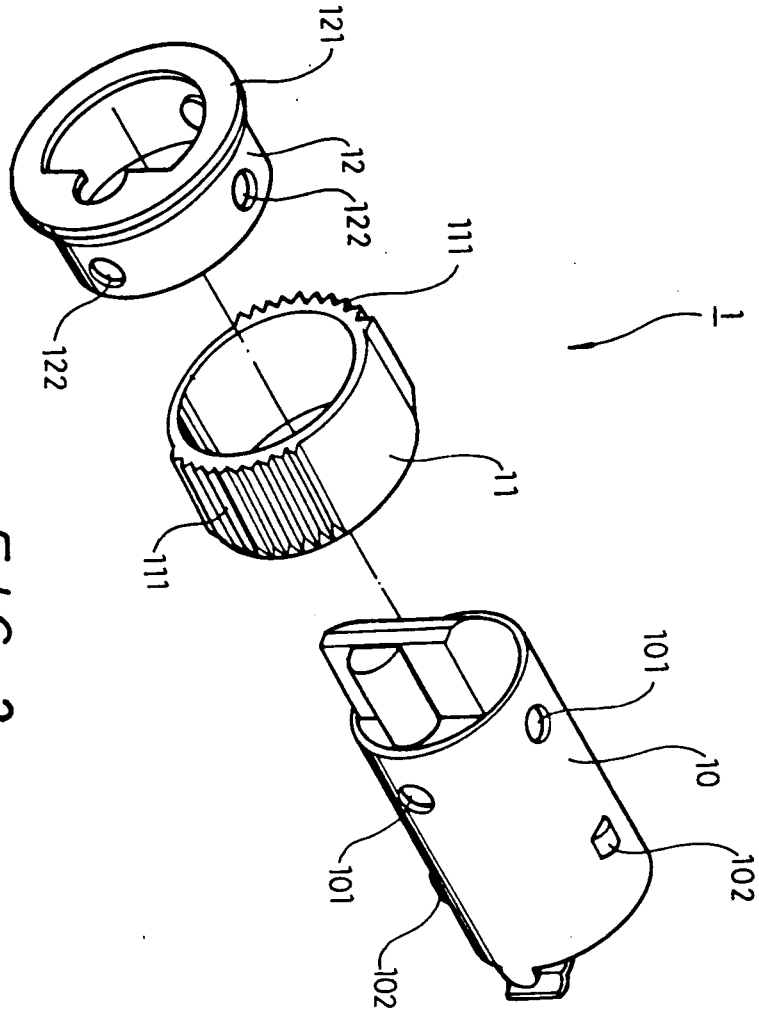
FIG. 3
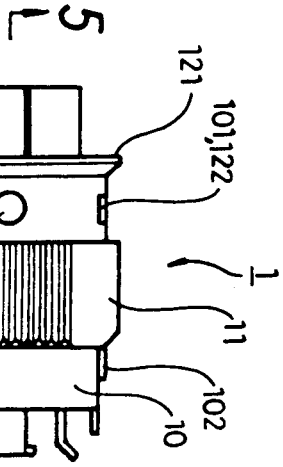
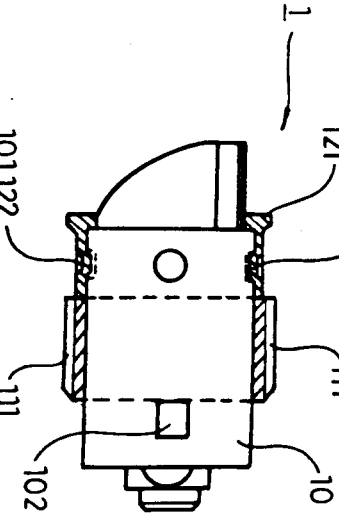
FIG. 4
FIG. 5

TUBULAR LATCH HOUSING

BACKGROUND OF THE INVENTION

This invention concerns a kind of tubular latch housing rotatable after mounted in a bore in a door and easy in combining with a lock set to have a correct mutual movement. As shown in FIG. 1, a tubular latch housing 1 is to be inserted in a lateral bore in a door and its end has to be combined with a lock set 2 mounted in a cross bore through the door. And the latch housing 1 has to be forced into the lateral bore for solid mounting therein. But as the latch housing 1 is round, it can be inclined after inserted therein as shown in FIG. 2, making its assembly with the lock set more difficult than otherwise.

Known device of this kind is disclosed in the U.S. Pat. No. 3,190,683 entitled "Retainers and tubular latch housing", wherein the tubular latch housing 21 is surrounded or encompassed by a sleeve 41. The sleeve 41 has an axial split 42 for pinching the latch housing 21 with some elasticity and permitting said housing 21 to be rotated in adjusting its position. Nevertheless, if the pinching force of the sleeve 41 against the latch housing 21 is too large, the latch housing 21 may be rather difficult to be rotated, and if the force is too small, the latch housing 21 may loosen off its position.

SUMMARY OF THE INVENTION

The object of this invention is to provide a tubular latch housing which can be rotated to adjust its position even after mounted in a bore in a door, making the process to combine with a lock set convenient.

The tubular latch housing in the present invention is provided with a plurality of projections on its outer periphery for restricting a ring to rotate between the projections and a face plate after the ring is fitted around the latch housing and the latch housing is assembled with the face plate. Thereby, the latch housing can be rotated inside the ring to adjust its position after mounted in a door bore.

BRIEF DESCRIPTION OF THE DRAWINGS

FIG. 3 is an exploded perspective view of the first embodiment of the tubular latch housing in the present invention.

FIG. 4 is an upside view of the first embodiment of the tubular latch housing in the present invention.

FIG. 5 is a cross-sectional view taken 5—5 along line of FIG. 4.

DETAILED DESCRIPTION OF THE INVENTION

Figure 1:
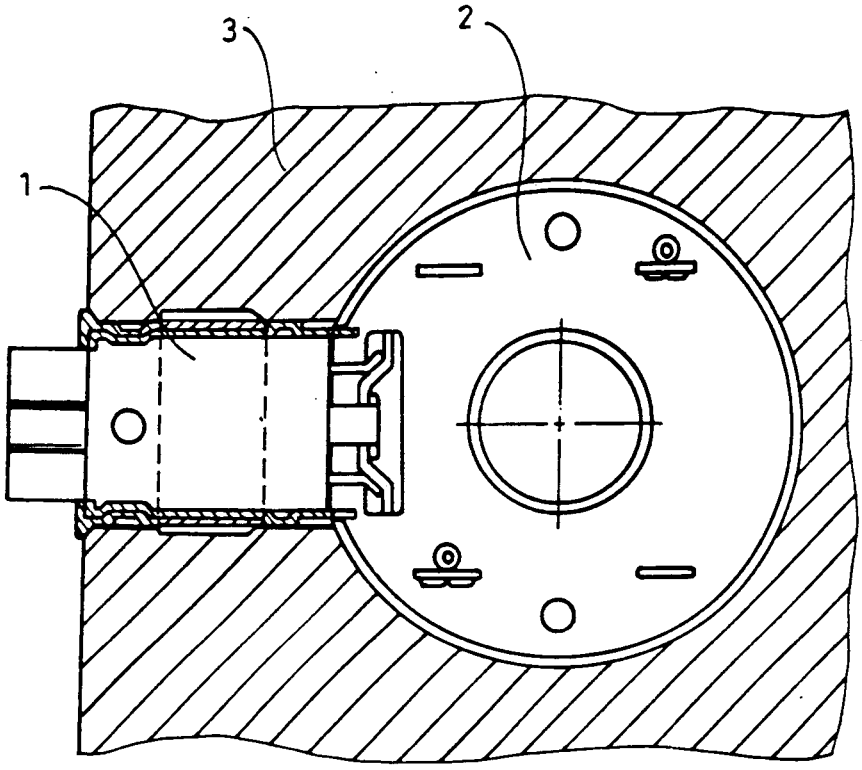
FIG. 1, is a cross-sectional view of the tubular latch housing combined with a lock set mounted in a door in the present invention.
Figure 2:
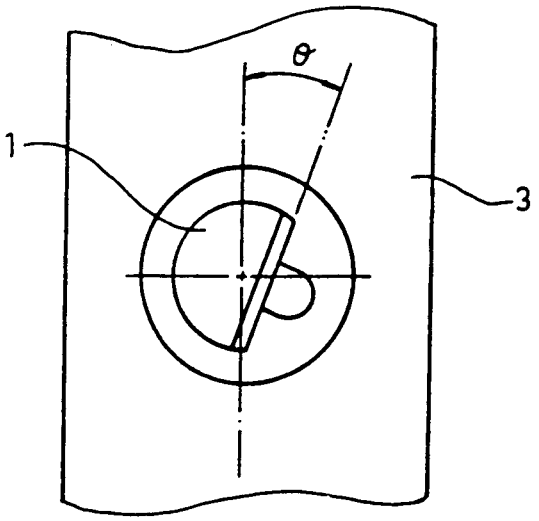
FIG. 2 is a left side view of FIG. 1.

FIG. 3 shows the first embodiment of this invention. As the internal structure of the tubular latch 1 is not the object of this invention, only the tubular latch housing 10 is described here.

The tubular latch housing 10 is provided with a plurality of recessed holes 101 on its outer periphery for recessed inward holes 122 in the periphery of a round face plate 12 to stick therein so that the tubular latch housing 10 and the face plate 12 can be combined together, without any possibility of separating from each other. The tubular latch housing 10 is also provided with a plurality of projections 102 to keep a ring 11 at its position after the ring 11 is fitted around the latch housing 10 before the face plate 12 is combined with the latch housing 10.

The ring 11 is to be fitted around the latch housing 10, shaped round and having an inner diameter approximately the same as the outer diameter of the latch housing 10 and a plurality of tooth-shaped straight ridges 111 on the outer periphery such that the ring 10 may be tightly stuck in a lateral door bore after inserted therein.

As shown in FIGS. 4 and 5, the ring 11 is first to be fitted around the latch housing 10, and then the face plate 12 is to be assembled with the latch housing 10 by means of pressing process. And the latch housing 10 is possible to rotate inside the ring 11 after those three parts are assembled together.

Figure 6:
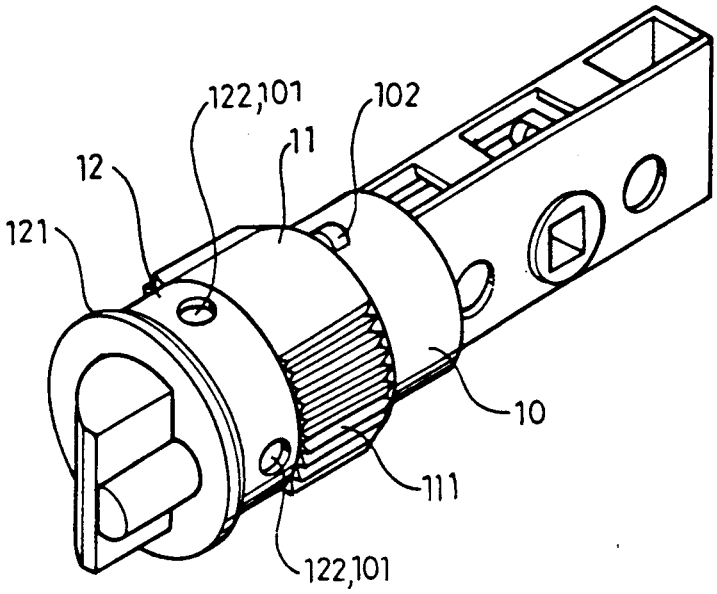
FIG. 6 is a perspective view of the second embodiment of the tubular latch housing in the present invention.
Figure 7:
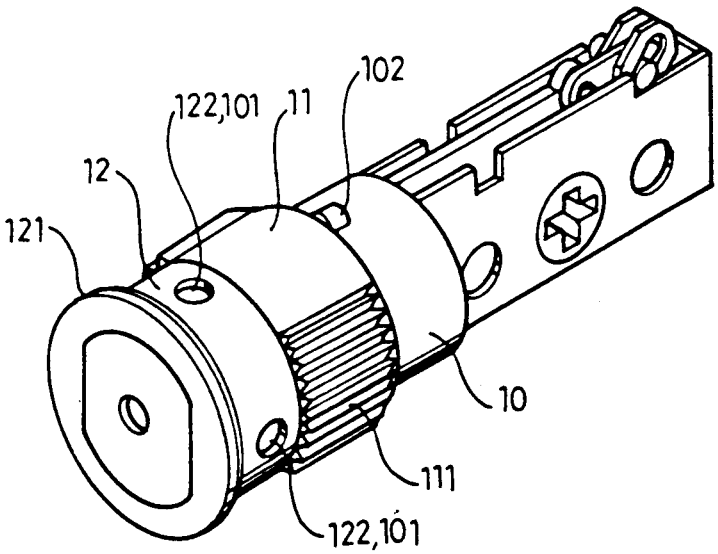
FIG. 7 is a perspective view of the third embodiment of the tubular latch housing in the present invention.

This tubular latch housing 10 can also be applied to another kind of lock set as shown in FIG. 6 and to an auxiliary lock set as shown in FIG. 7.

As shown in FIG. 1, in mounting the latch 1 in a lateral bore in a door, the latch 1 must be inserted into the bore with force, letting the tooth-shaped ridges 111 on the ring 11 stick in the wood of the door, but as the latch housing 10 can rotate inside the ring 11 as to be adjusted in its position, there arises no problem of any inclined position or reverse mounting of the latch housing 10. Thereby, the latch 1 can be accurately assembled with the lock set, keeping correct mutual movement of the both.

What is claimed is:

1. A tubular latch housing provided with a plurality of projections on its outer periphery, a face plate at one end of the housing and a ring fitted around said housing and retained between the face plate and the projections and the latch housing being able to rotate inside the ring for adjusting its position angularly when mounted in a door.

2. A latch housing as claimed in claim 1 wherein the ring has an outer surface with axially extending tooth-like projections.

* * * * *